US011143433B2

(12) United States Patent
Bauer et al.

(10) Patent No.: US 11,143,433 B2
(45) Date of Patent: Oct. 12, 2021

(54) DRAIN PAN EXTENSION

(71) Applicant: Advanced Distributor Products LLC, Richardson, TX (US)

(72) Inventors: John Bauer, Grenada, MS (US); Michael Denley, Calhoun City, MS (US)

(73) Assignee: Advanced Distributor Products LLC, Richardson, TX (US)

( * ) Notice: Subject to any disclaimer, the term of this patent is extended or adjusted under 35 U.S.C. 154(b) by 194 days.

(21) Appl. No.: 16/427,694

(22) Filed: May 31, 2019

(65) Prior Publication Data

US 2020/0378647 A1 Dec. 3, 2020

(51) Int. Cl.
*F24F 13/22* (2006.01)

(52) U.S. Cl.
CPC ..... *F24F 13/222* (2013.01)

(58) Field of Classification Search
CPC ..... F24F 13/222; F24F 13/224; F24F 13/22; F25D 21/14; F28B 9/08; F28F 17/005; B65D 21/02; B65D 21/0201; B65D 21/0202; B65D 21/0235; B65D 21/0237; B65D 21/08; B65D 21/083; B65D 21/086
See application file for complete search history.

(56) References Cited

U.S. PATENT DOCUMENTS

| | | | | |
|---|---|---|---|---|
| 958,857 | A * | 5/1910 | Dennis | A47J 47/20 220/8 |
| 4,046,279 | A * | 9/1977 | Rosler | B65D 21/086 220/8 |
| 5,016,772 | A * | 5/1991 | Wilk | B65D 21/086 220/495.01 |
| 9,410,731 | B1 * | 8/2016 | Rowland | F24F 13/222 |
| 2007/0169497 | A1 * | 7/2007 | Rios | F24F 13/222 62/285 |
| 2016/0209101 | A1 * | 7/2016 | Hawley, III | F25D 21/14 |

* cited by examiner

*Primary Examiner* — Tavia Sullens
(74) *Attorney, Agent, or Firm* — Baker Botts L.L.P.

(57) ABSTRACT

An apparatus includes a drain pan configured to receive liquid condensate from a horizontal evaporator coil above the drain pan and a drain pan extension coupled to the drain pan. A pin on the front and rear sides of the drain pan extension is fitted and movable within a corresponding notch in the front and rear sides of the drain pan. The drain pan extension is securably configurable in a first configuration and a second configuration. In the first configuration, the drain pan extension extends above the drain pan at a first predefined angle relative to the drain pan. In the second configuration, at least a portion of the drain pan extension extends beyond the left pan side of the drain pan at a predefined angle, which may be selected for improved capture of liquid condensate from the horizontal evaporator coil.

12 Claims, 8 Drawing Sheets

DRAIN PAN EXTENSION

TECHNICAL FIELD

This disclosure relates generally to heating, ventilation, and air conditioning (HVAC) systems. In particular embodiments, this disclosure relates to a reconfigurable drain pan extension for use with a horizontal evaporator coil.

BACKGROUND

Heating, ventilation, and air conditioning (HVAC) systems are used to regulate environmental conditions within an enclosed space. HVAC systems include a horizontal evaporator coil for cooling and/or dehumidifying air and a blower that pulls warm air from the enclosed space and pushes the air across the horizontal evaporator coil before it is returned, as conditioned air, via one or more ducts to the enclosed space. During operation of the horizontal evaporator coil, water vapor from the warm air passing over the coil condenses on the surface of the coil. A drain pan can be placed below the horizontal evaporator coil to capture this water as it falls in a vertical direction from the coil, thereby limiting the risk of moisture damage to the underlying floor (e.g., an attic floor). However, under normal operating conditions liquid water on the evaporator coil can also be pushed in a horizontal direction by air flowing across the evaporator coil such that the water is not captured by the drain pan, resulting in damage to components of the HVAC system downstream from the evaporator coil and/or to the region surrounding the evaporator coil that is not protected by the drain pan (e.g., the floor surrounding the drain pan). There exists a need for improved apparatus for preventing the undesired spread of this liquid water from the evaporator coil.

SUMMARY OF THE DISCLOSURE

As described above, HVAC systems include an evaporator coil installed in a horizontal orientation or a "horizontal evaporator coil." A horizontal evaporator coil for a residential HVAC system is installed in an attic space. A drain pan placed below the evaporator coil on the attic floor can generally capture liquid condensate as it drips in a vertical direction from the evaporator coil. However, the drain pan typically fails to capture liquid condensate that is pushed horizontally from the surface of the coil by air flowing through the HVAC system (i.e., air flowing across the evaporator coil). This liquid condensate that is pushed in a horizontal direction is sometimes referred to as evaporator "blow off" and can result in moisture damage (e.g., corrosion and/or growth of biological contamination such as mold) in both the HVAC system (e.g., the surface of ducts downstream from the evaporator coil) and the surroundings of the horizontal evaporator coil (e.g., the attic floor and/or the underlying portion of the ceiling in a room below the attic).

This disclosure contemplates an apparatus that includes a reconfigurable drain pan extension that can be coupled to a drain pan prior to its installation, and used to collect evaporator blow off from a horizontal evaporator coil to prevent damage to the region surrounding the coil. The apparatus, in certain embodiments, includes a drain pan configured to receive liquid condensate from a horizontal evaporator coil positioned above the drain pan and a drain pan extension coupled to the drain pan. The front and rear sides of the drain pan each includes a horizontal notch, and the front and rear sides of the drain pan extension each includes a pin that is fitted within and movable with the corresponding notch of the drain pan. The bottom surface of the drain pan extension includes one or more stoppers positioned such that the drain pan extension is securably configurable in (i) a first (e.g., transportation) configuration in which a surface of the drain pan extension is at or near an edge of the horizontal evaporator coil and (ii) a second (e.g., installation) configuration in which the one or more stoppers contact the left side of the drain pan so that a portion of the drain pan extension extends beyond the left side of the drain pan at a predefined angle relative to the drain pan. The predefined angle is generally selected for improved collection of evaporator blow off, based on the intended operating parameters of the evaporator coil and/or a corresponding HVAC system.

In the first configuration, the drain pan extension may provide protection to the horizontal coil when it is transported (e.g., from a point of manufacture or sale to a point of installation). The installer can then efficiently reconfigure and secure the drain pan extension from the first configuration to the second configuration, which facilitates effective capture of liquid condensate blow off from the horizontal evaporator coil based on the intended operating conditions of the coil and/or the overall HVAC system of which it is a part.

The second configuration may be determined by the length of the horizontal notches of the drain pan and/or the size and positioning of the stopper(s) on the drain pan extension. These parameters may be selected and designed at the time of manufacture to ensure the drain pan extension is in an evaporator-specific installation configuration, based on an anticipated amount and trajectory of liquid condensate in the evaporator blow off. For example, one or more stoppers on the drain pan may be of an appropriate height and positioned an appropriate distance from the edge of the extension on the bottom surface of the extension to facilitate the automatic and secure configuration of the drain pan extension at an appropriate angle for capturing liquid condensate from the evaporator blow off expected for an HVAC system rated for a given range of rates of air flow across the evaporator coil. As such, the apparatus of the present disclosure facilitates the straightforward adjustment of the drain pan extension to an evaporator-specific installation configuration based on known properties of the HVAC system and or the horizontal evaporator coil (e.g., expected maximum airflow rates through the horizontal evaporator coil, e.g., size of the horizontal evaporator coil, e.g., expected rate of liquid condensation on the horizontal evaporator coil).

Certain embodiments of the apparatus described herein include one or more additional locking mechanisms for further securing the extension in the first configuration during transport and/or for securing the extension in the second configuration after installation. For example, the locking mechanism may allow the drain pan extension to be attached in a reversible manner to the evaporator coil such that it securely protects the coil during its transport and yet is easily un-attached from the coil at the time of installation. This embodiment may provide further protection to the horizontal evaporator coil during its transport.

In certain embodiments, the drain pan extension can be configured at a plurality of angles such that a single extension can be used for a range of horizontal evaporator coil types and for a range of HVAC operating conditions. For example, different drain pan extension angles can be achieved using one or more additional stoppers on the bottom surface of the drain pan extension (e.g., as shown in FIGS. 3A-C) or via one or more vertical grooves in the notch of the drain pan (e.g., as shown in FIGS. 4A-C).

These one or more additional configurations of the drain pan extension may facilitate the installation of the apparatus with a wider variety of HVAC systems and/or in different environments. For example, an HVAC system with a large evaporator coil may have different evaporator blow off characteristics than a system with a relatively small evaporator coil, and the drain pan extension can be automatically configured during installation by simply selecting the appropriate configuration. Similarly, an HVAC system installed in a high humidity environment may have different evaporator "blow off" characteristics than a system installed in a relatively low humidity environment. Accordingly, the apparatus may be provided with instructions for appropriately configuring the drain pan extension based on the properties of the HVAC system and/or the local environment. This facilitates the straightforward installation and adjustment of the same apparatus for a variety of operating conditions. Moreover, the drain pan extension can be reconfigured as needed (e.g., between seasons) without requiring complicated maintenance activities (e.g., drilling through the drain pan).

In certain embodiments, the drain pan extension is constructed from a corrosion-resistant material such as a plastic or a corrosion resistant alloy. In some embodiments, the drain pan extension is constructed from the same material as the drain pan.

Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1A:
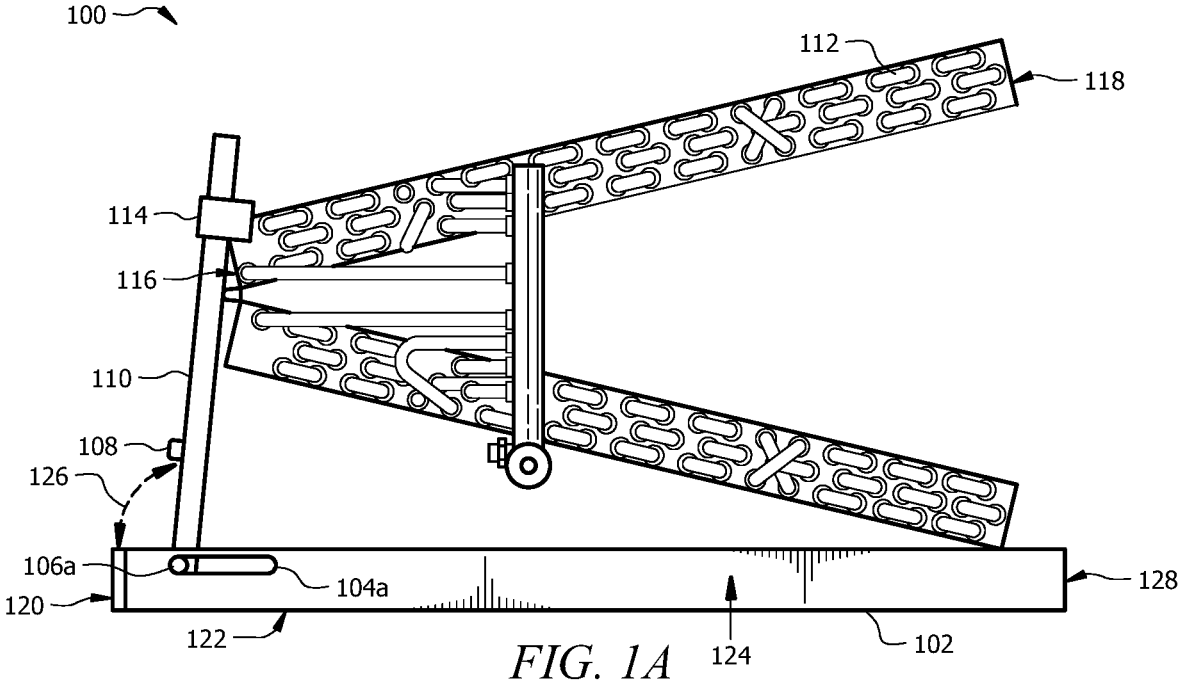
FIGS. 1A-C are diagrams of the apparatus, according to an illustrative embodiment of the present disclosure.

Embodiments of the present disclosure and its advantages are best understood by referring to the drawings, like numerals being used for like and corresponding parts of the various drawings.

Figure 1B:
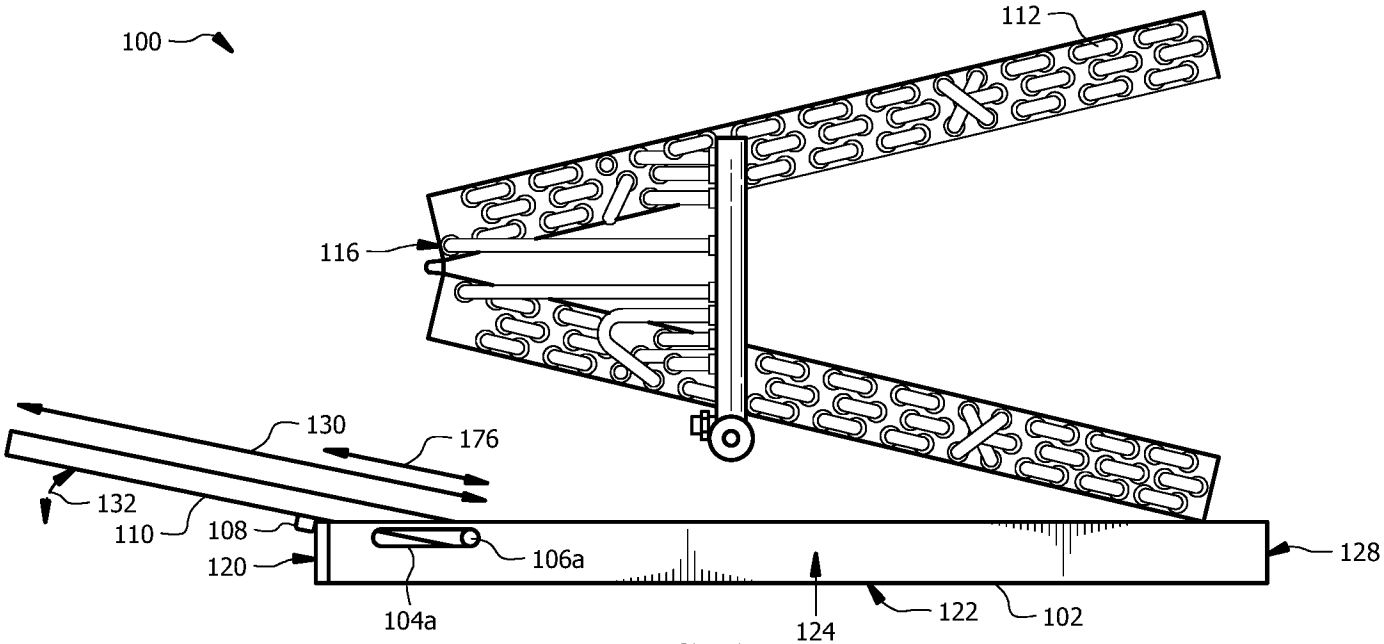
Figure 1C:
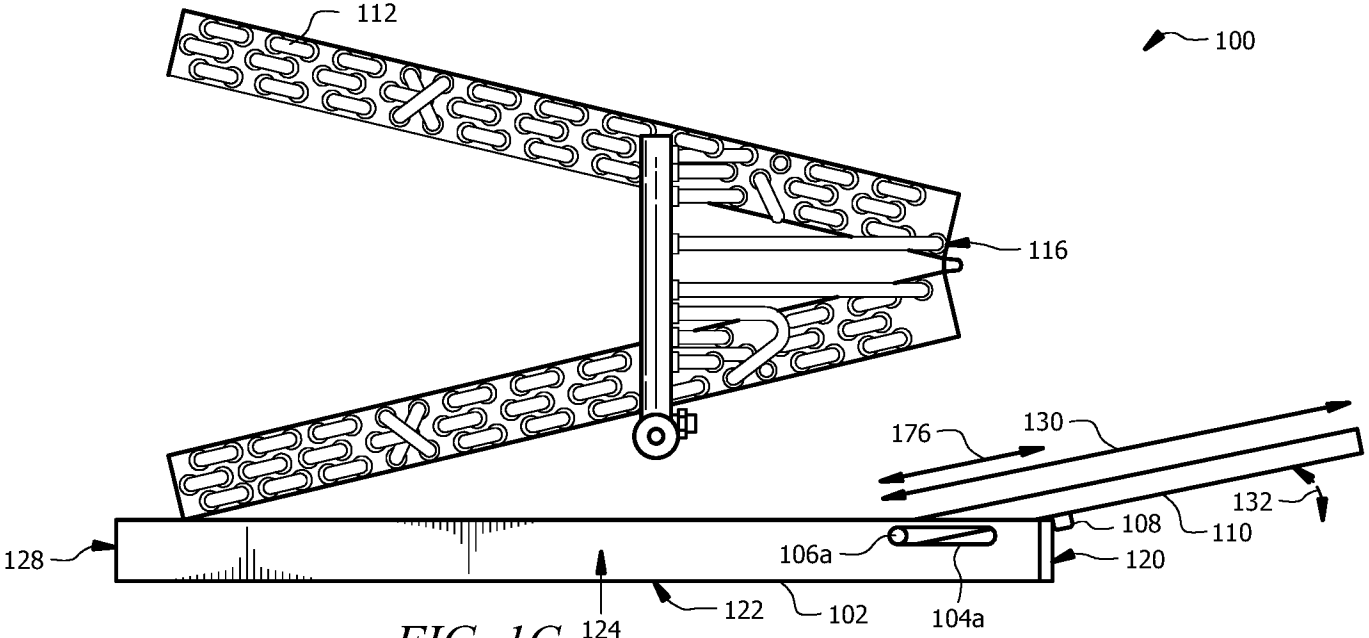
Figure 2A:
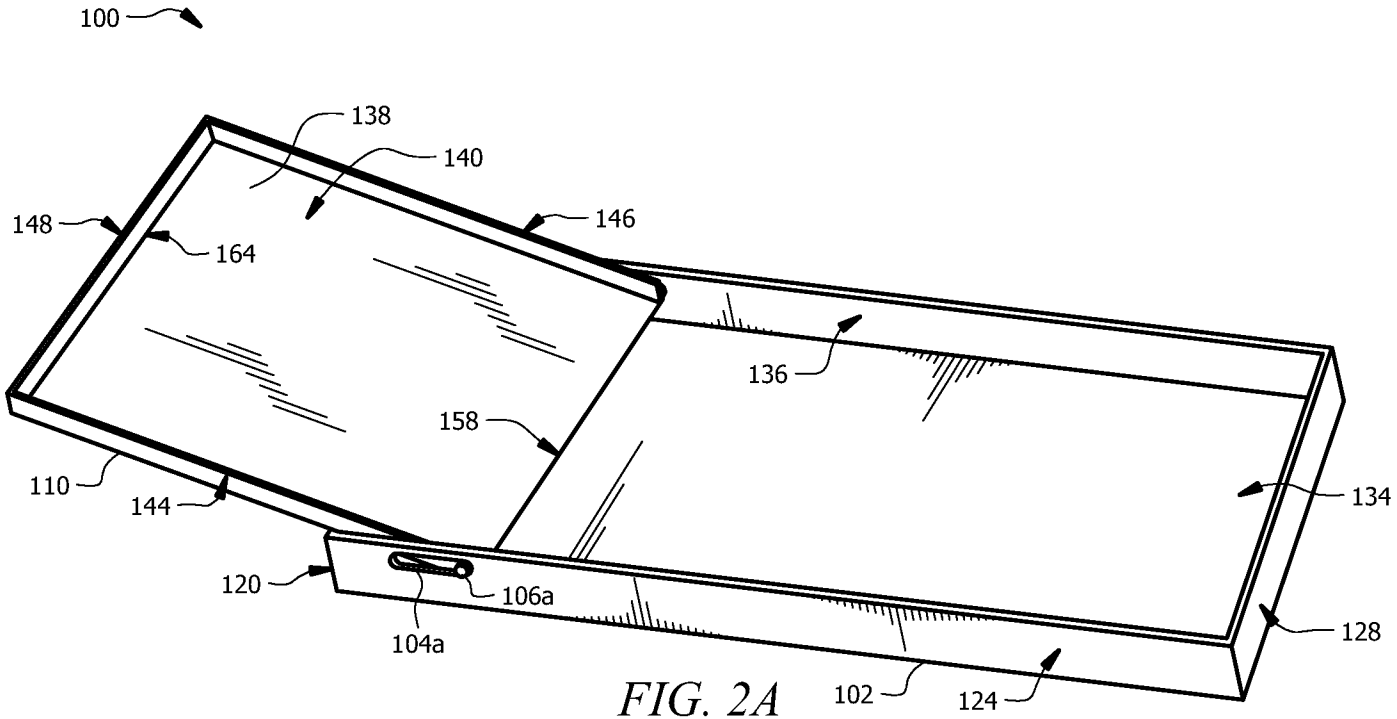
FIGS. 2A-C are diagrams of the apparatus of FIGS. 1A-C from perspective views.
Figure 2B:
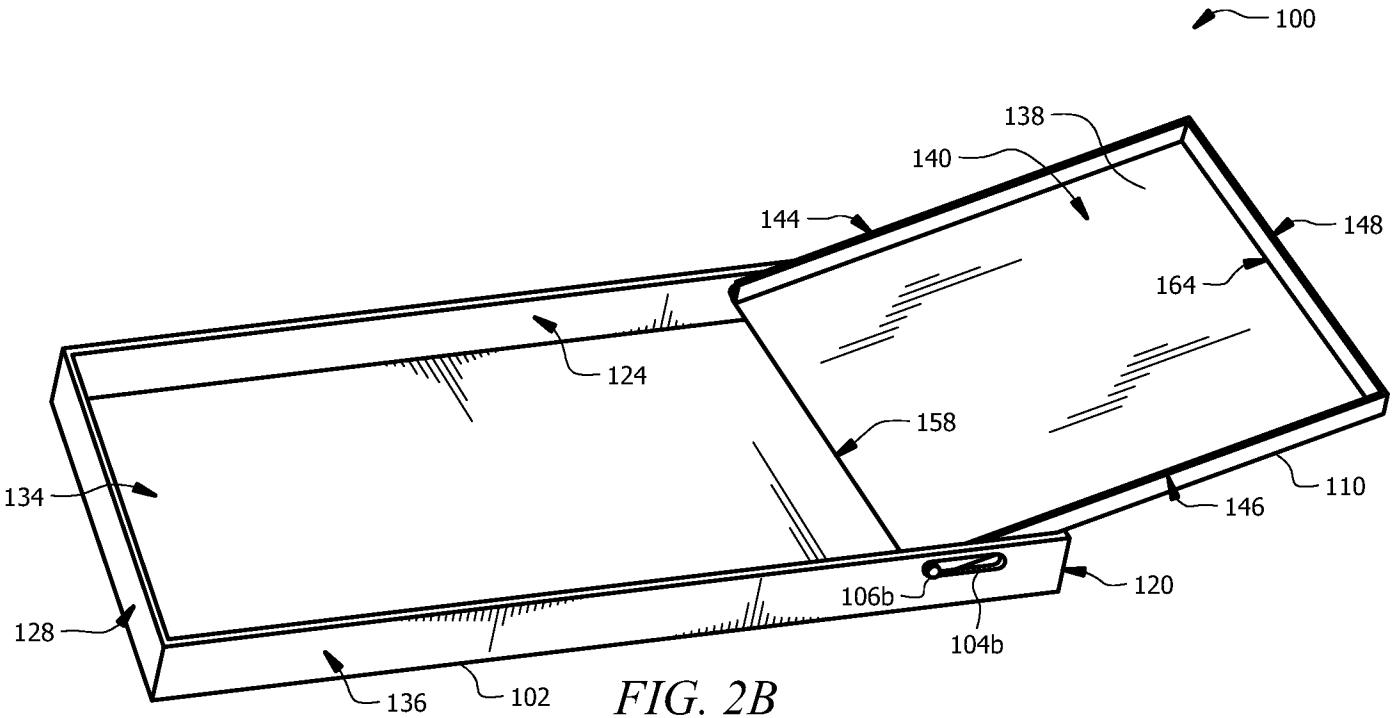
Figure 2C:
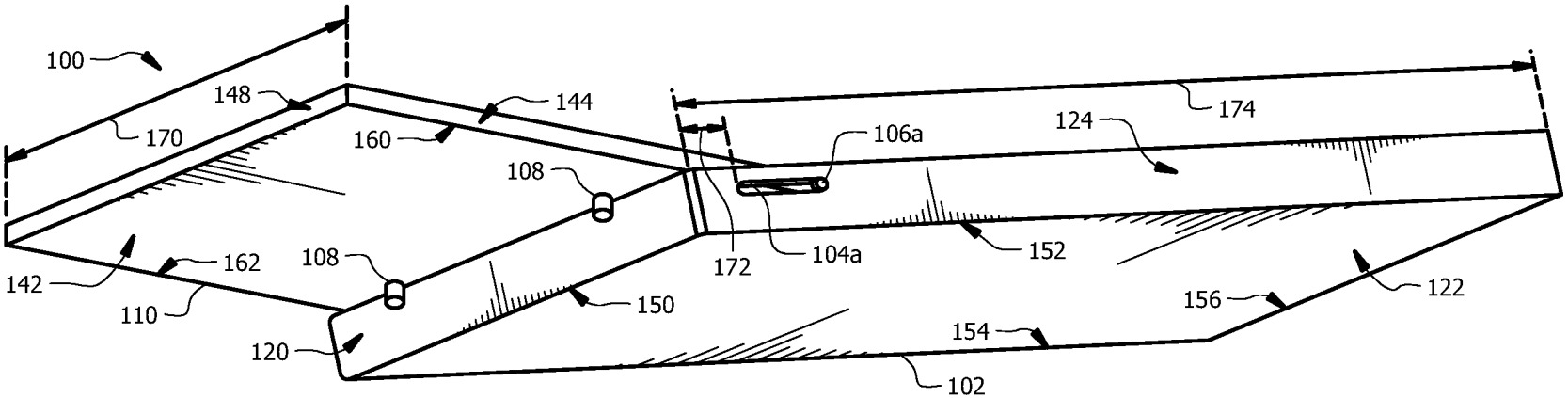

FIGS. 1A-C and 2A-C show an example apparatus 100 according to the present disclosure. FIGS. 1A and 1B show apparatus 100 in a first configuration (e.g., a transportation configuration) and a second configuration (e.g., an installation configuration), respectively. FIGS. 2A-C show perspective views of the apparatus 100 in the second (e.g., installation) configuration of FIG. 1B.

Apparatus 100 is generally configured to receive liquid condensate from an evaporator coil 112, as shown in FIGS. 1A and 1B. For example, the apparatus 100 may be placed below the evaporator coil 112 to receive liquid condensate from the coil 112. Apparatus 100 includes a drain pan 102 disposed below the coil 112, and a drain pan extension 110 attached to the drain pan 102. The drain pan 102 has a first notch 104*a* (e.g., a front notch) and second notch 104*b* (e.g., a rear notch) such that a first pin 106*a* (e.g., the front pin) and a second pin 106*b* (e.g., the rear pin) of the drain pan extension 110 are fitted and slidably movable within the correspond notch of notches 104*a* and 104*b*. The notches 104*a,b* and pins 106*a,b* generally facilitate adjustment of the drain pan extension 110 between two or more configurations, including the first (e.g., transportation) configuration and the second (e.g., installation) configurations shown in FIGS. 1A and 1B, respectively.

The evaporator coil 112 may be a horizontal evaporator coil. The evaporator coil 112 may be positioned on or above and/or be attached to a top surface 134 of the base 122 of the drain pan 102. For example, a base and/or other support of the evaporator coil 112 may be attached to the top surface 134 (see FIGS. 2A-C) of the drain pan 102, or a portion of the evaporator coil 112 may be allowed to rest on top of or within the drain pan 102. The evaporator coil 112 may include one or more circuits for the flow of a working fluid (e.g., a refrigerant). The working fluid may be any acceptable working fluid including, but not limited to, fluorocarbons (e.g. chlorofluorocarbons), ammonia, non-halogenated hydrocarbons (e.g. propane), hydroflurocarbons (e.g., R-410A), or any other suitable type of refrigerant. The evaporator coil 112 generally acts as a heat exchanger, providing heat transfer between air flowing across the coil 112 (i.e., contacting an outer surface of the evaporator coil 112) and working fluid passing through the interior of the evaporator coil 112. In a typical HVAC system, the evaporator coil 112 is fluidically connected to a condenser and a compressor (not shown), such that cool liquid-phase working fluid flows from the condenser to the evaporator coil 112 and heated vapor-phase working fluid flows from the evaporator coil 112 to the compressor.

The drain pan 102 is generally configured to capture liquid condensate falling from the evaporator coil 112 (i.e., falling downward under the influence of gravity). The drain pan 102 may be made of a corrosion-resistance material such as a plastic or a corrosion-resistant alloy. The drain pan 102 includes a pan base 122, a left pan side 120 extending along the left edge 150 of the pan base 122, a right pan side 128 extending along the right edge 156 of the pan base 122, a front pan side 124 extending along the front edge 152 of the pan base 122, and a rear pan side 136 extending along the rear edge 154 of the pan base 122. Each of the left pan side 120, the right pan side 128, the front pan side 124, and the rear pan side 136 extends in an upward direction from the top surface 134 of the pan base 122 to form the drain pan 102. Each of the sides 120, 124, 128, 136 may have a height of about 1 to 10 inches. Any one or more of the pan sides 120, 124, 128, 136 may have a different height as appropriate for collecting liquid condensate falling from the evaporator coil 112.

The left pan side 120 of the drain pan 102 generally extends at least to the left edge 116 of the evaporator coil 112. However, in preferred embodiments, the left pan side 120 of the drain pan 102 is positioned beyond the edge of the evaporator coil 112 by about 3 to 12 inches. The right pan side 128 of the drain pan 102 is generally similarly configured such that the right pan side 128 is at least positioned in line with the right edge 118 of the evaporator coil 112. The front side 124 and rear side 136 of the drain pan 102 similarly extend at least to a front edge and rear edge of the evaporator coil 112 to capture condensed liquid falling therefrom. In some embodiments, the rear pan side 128, front side 124, and/or rear side 136 of the drain pan 102 extend about 3 to 12 inches from the corresponding edge of the evaporator coil 112.

The front pan side 124 includes a first horizontal notch 104*a*, and the rear pan side 136 includes a second horizontal notch 104*b*. The horizontal notches 104*a,b* generally facilitate coupling of the drain pan extension 110 to the drain pan 102. Each notch 104*a,b* may have an approximately rectangular or rounded rectangular shape. As shown in FIG. 2C, notch 104*a* extends along a portion of the front pan side 124. The notch 104*a* may extend from a distance 172 (e.g., of about 0.1 inch) from the left edge 150 of the base 122 of the drain pan 102 (e.g., from the left pan side 120) to less than the entire length 174 of the front pan side 124. As shown in FIG. 2B, a similar notch 104*b* is in the rear side 136 of the drain pan 102. In some embodiments, the notches 104*a,b* extend for less than about 25% of the length of the front pan side 124. In some embodiments, the length of each of notches 104*a,b* is in range from about 0.5 to 8 inches. The height of each of notches 104*a,b* may be in range from about 0.1 to about 3 inches.

The drain pan extension 110 is slidably coupled to the drain pan 102 via pins 106*a,b* that are fitted and movable within the horizontal notches 104*a,b* of the drain pan 102. The drain pan extension 110 is generally configured to capture liquid condensate falling from the evaporator coil 112 that is pushed horizontally by air flowing across the coil 112 (i.e., in the leftward direction in the view of FIGS. 1A-B and 2A-C). The drain pan extension 110 is movable between and securable in the first (e.g., transportation) configuration shown in FIG. 1A and the second (e.g., installation) configuration shown in FIG. 1B. The drain pan extension 110 may be made of a corrosion-resistant material such as a plastic or a corrosion-resistant alloy. In some embodiments, the drain pan extension 110 is made of the same material as that of the drain pan 102.

The drain pan extension 110 includes a base 138, a front side 144 extending along the front edge 160 of the base 138, an optional left side 148 extending along the left edge 164 of the base 138, and a rear side 146 extending along the rear edge 162 of the base 138. Each of sides 144, 146, and 148 extends vertically from (e.g., normal to, or approximately perpendicular to) the top surface 140 of the base 138 of the drain pan extension 110. The drain pan extension 110 may have a length 130 (FIG. 1B) similar to the height of the leftmost edge 116 of the evaporator coil 112 and a width 170 (FIG. 2C) similar to the width of the drain pan 102. For example, the length 130 of the drain pan extension 110 may be between about 6 and 36 inches, and the width of the drain pan extension 110 may be between about 6 and 36 inches.

The front side 144 and rear side 146 of the drain pan extension 110 include pins 106*a* and 106*b*, respectively, that facilitate coupling of the drain pan extension 110 to the drain pan 102 via notches 104*a,b*. As shown in FIGS. 2A-B, the pins 106*a,b* are generally positioned an equal distance (e.g., of at least 0.1 inch) from the right edge 158 of the base 138 of the drain pan extension 110. The pins 106*a,b* are fitted and horizontally movable within the corresponding notches 104*a,b* of the drain pan 102. The pins 106*a,b* may be any appropriate protrusions for fitting into and moving within the corresponding notches 104*a,b* of the drain pan 102. For example, the pins 106*a,b* may be sized and shaped to fit and move within the notches 104*a,b*. In some embodiment, an end cap or cover may be affixed to the end of one or more of the pins 106*a,b* to prevent the pins 106*a,b* from being removed from the corresponding notch 104*a,b* and to further facilitate the secure coupling of the drain pan extension 110 to the drain pan 102.

The bottom surface 142 of the drain pan extension 110 includes stoppers 108 (FIG. 2C) positioned a predefined distance 176 (FIG. 1B) from the right edge 158 (FIG. 2A-B) of the base 138 of the drain pan extension 110 such that the drain pan extension 110 is securably configurable in the first configuration shown in FIG. 1A and the second configuration shown in FIG. 1B. The stoppers 108 protrude from the bottom surface 142 of the drain pan extension 110 and facilitate securing the drain pan extension 110 in the predefined second (e.g., installation) configuration shown in FIG. 2B. The stoppers 108 may include a securing mechanism such as a clasp or lock to further secure the drain pan extension in the second configuration. For instance, a clasp on one of stoppers 108 may be attached to the left side 120 of the drain pan 102 or to a surface on which the drain pan 102 is placed. While the illustrative example of FIGS. 1A-B and 2A-C show cylindrically shaped stoppers 108, it should be understood that any other stopper shape or type may be used without departing from the scope of the present disclosure.

Now referring to FIG. 1A, in the first (e.g., transportation) configuration, the drain pan extension 110 is generally configured at a predetermined angle 126 that is equal to or greater than 90°. For example, angle 126 may be between 90° and 180°. Angle 126 is generally determined by the extent to which the drain pan 102 extends beyond the edge 116 of the evaporator coil 112, the height of the evaporator coil 112 above the drain pan 102, and/or the positions of notches 104*a,b* and pins 106*a,b*. In the first (e.g., transportation) configuration shown in FIG. 1A, the drain pan extension 110 may rest against the edge 116 of the evaporator coil 112. In some embodiments, the drain pan extension 110 and/or the evaporator coil 112 includes a securing mechanism 114 that is operable to secure the drain pan extension 110 to the edge 116 of the evaporator coil 112. The securing mechanism 114 may be any appropriate clasp, lock, or adapter for securably attaching the drain pan extension 110 to the evaporator coil 112. For example, the securing mechanism 114 may be a clasp that is attached to the evaporator coil 112 to secure the drain pan extension 110 in the first configuration shown in FIG. 1A. In some embodiments, the securing mechanism 114 is a temporary securing mechanism (e.g., a removable tie) that is removed and discarded after installation.

During installation, the drain pan extension 110 is moved and/or rotated to the second configuration shown in FIG. 1B. In the second configuration, the drain pan extension 110 may be at an angle 132 relative to the top surface 134 of the base 122 of the drain pan 102. Angle 132 may generally be any angle that is appropriate for capturing liquid condensate blow off from the evaporator coil 112. In certain embodiments, angle 132 is less than or equal to 45°. In some embodiments, the angle 132 is between about 10° and 20°.

Generally, angle 132 may be determined based on properties of the evaporator coil 112 and/or of an HVAC system associated therewith. For example, angle 132 may be determined based on a known range of rates of airflow across the evaporator coil 112, because the rate of airflow will determine the distance traveled in a horizontal direction by liquid condensate on the surface of the evaporator coil 112. The angle 132 may be determined based on the height and/or type of the evaporator coil 112. For example, if the height of the evaporator coil 112 relative to the drain pan 102 is increased, the value of angle 132 may be increased to facilitate capture of liquid condensate blow off from the coil 112. A selected value for angle 132 is then determined based on one or more of the length of the horizontal notches 104*a,b*, the position of stoppers 108 on the bottom surface 142 of the drain pan extension 110, and the height of stoppers 108. The relationship between angle 132 and the configuration of various components of the apparatus 100 is described in greater detail below with respect to FIGS. 3A-C.

Referring to FIG. 1B, during an example operation of the apparatus 100 (e.g., during operation of an HVAC system comprising the evaporator coil 112 and the apparatus 100), warm air flows across the evaporator coil 112 and is cooled via heat transfer with the working fluid flowing through the evaporator coil 112. During this heat transfer, liquid condensate (i.e., liquid water) may form on the outer surface of the evaporator coil 112. This liquid condensate can fall downwards (i.e., in a vertical direction) and/or be pushed horizontally (e.g., to the left in the view of FIGS. 1A and 1B) by air flowing across the evaporator coil 112. In the absence of the drain pan extension 110, at least a portion of the liquid condensate pushed horizontally by the air flow may not be captured by the drain pan 102, resulting in possible damage to the underlying surface. When the drain pan extension 110 is present, as in apparatus 100, this liquid condensate is captured and redirected into the drain pan 102, preventing or significantly reducing damage to the underlying surface.

The length 130 and angle 132 of the drain pan extension 110 in the second configuration shown in FIG. 1B may be determined at the time of manufacture to ensure the drain pan extension can be secured in a predetermined installation configuration, based on an anticipated amount and trajectory of liquid condensate in the evaporator blow off. As described above, by providing the preconfigured installation configuration shown in FIG. 1B, the apparatus 100 facilitates appropriate placement of drain pan extension 110 without risk of installer error and without requiring after-market modification and possible damage to the drain pan 102.

While FIGS. 1A-B show the apparatus 100 in a "left-hand" configuration in which the drain pan extension 110 of the apparatus 100 extends to the left relative to coil 112, it should be understood that the apparatus can be installed in a "right-hand" configuration in which the drain pan extension 110 extends to the right relative to coil 112. For example, the apparatus 100 can be rotated to accommodate the right-hand configuration shown in FIG. 1C.

Figure 3A:
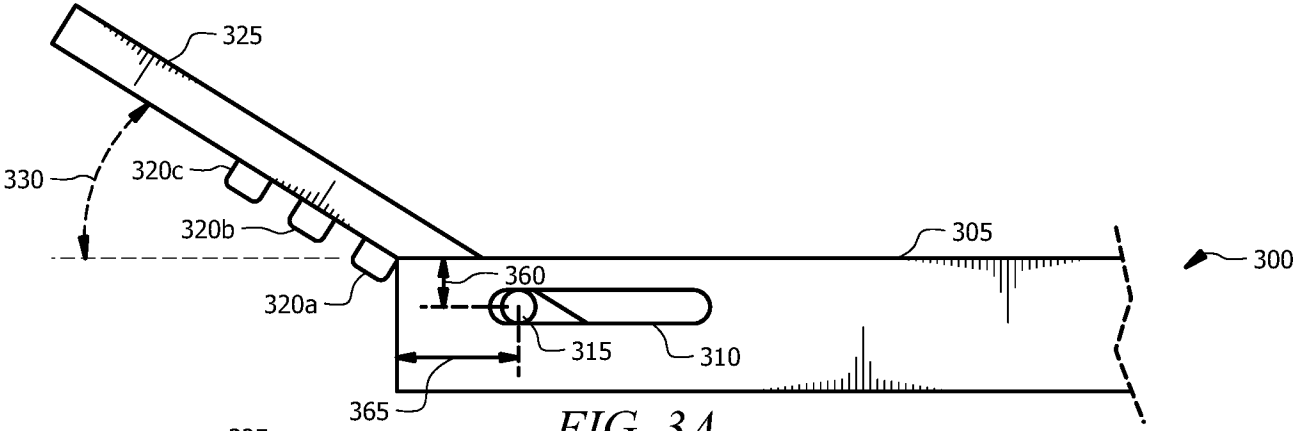
FIGS. 3A-C are diagrams of the apparatus comprising additional stoppers with the drain pan extension in different configurations, according to an illustrative embodiment.
Figure 3B:
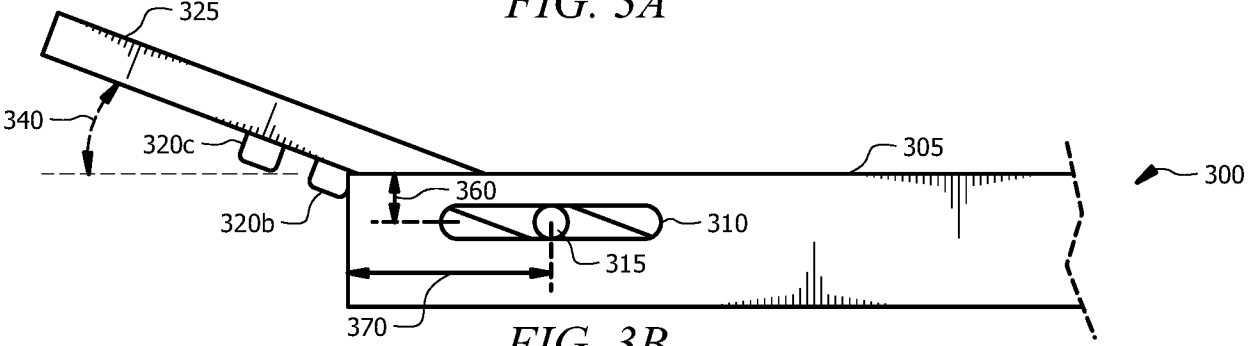
Figure 3C:
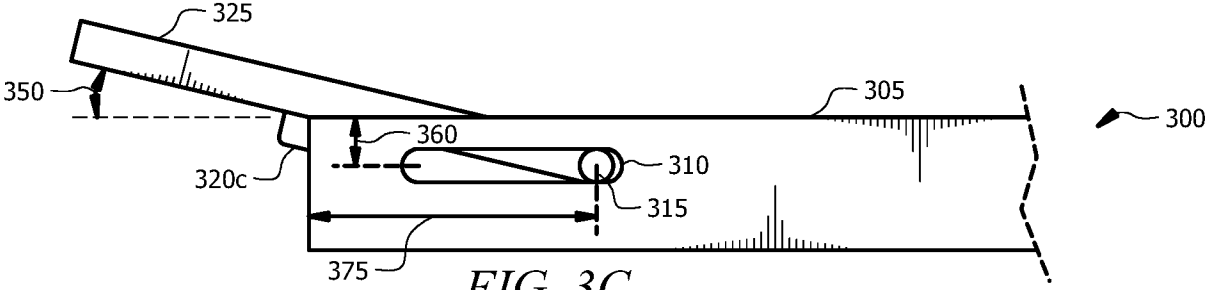

FIGS. 3A-C show an example of a portion 300 of an apparatus that is configurable in multiple installation configurations (i.e., at multiple predetermined installation angles). For example portion 300 may be a portion of apparatus 100 shown in FIGS. 1A-B and 2A-C, described above. Accordingly, as would be understood by one skilled in the art, drain pan 305 and drain pan extension 325 may include each of the parts and features of drain pan 102 and drain pan extension 110, respectively, described above with respect to FIGS. 1A-B and 2A-C. In the illustrative examples of FIGS. 3A-C, the different configurations are realizable using stoppers 320*a-c*. The apparatus includes the same features and components described with respect to apparatus 100 above. However, in the portion 300 of the apparatus shown in FIGS. 3A-C, the bottom surface of the drain pan extension 325 includes stoppers 320*a-c* at different distances from the right edge of the base of the drain pan extension 325. Each of the stoppers 320*a-c* facilitates configuration of the drain pan extension 325 in a different installation configuration, which may be selected to improve capture of liquid condensate from an evaporator coil.

FIG. 3A shows the drain pan extension 325 in a first installation configuration. In this configuration, the pin 315 is near the left edge of notch 310 such that there is a relatively short distance 365 between pin 315 and the left side of the drain pan 305. The drain pan extension 325 is held in the first installation configuration by stopper 320*a*. The angle 330 between the drain pan extension 325 and the drain pan 305 is determined, based on geometric considerations, by the height 360 of the drain pan 305 relative to the notch 310 and the distance 365. For instance, the tangent of angle 330 is approximately given by height 360 divided by distance 365. When the ratio of height 360 to distance 365 is large (i.e., corresponding to the case where the pin 315 is near the left side of the drain pan 305 as in FIG. 3A), the value of angle 330 is relatively large. Accordingly, in the first installation configuration shown in FIG. 3A, the drain pan extension 325 is at a relatively large angle 330.

FIG. 3B shows the drain pan extension 325 in a second installation configuration. The drain pan extension 325 is held in the second installation configuration by stopper 320*b*. Stopper 320*b* is a greater distance from the right edge of the drain pan extension 325 than is stopper 320*a*. In this configuration, the pin 315 is near the center of notch 310 such that there is a longer distance 370 between pin 315 and the left side of the drain pan 305, compared to the first configuration shown in FIG. 3A. Because of the same geometric considerations described above, in the second installation configuration shown in FIG. 3B, the drain pan extension 325 is at a smaller angle 340 relative to angle 330 shown in FIG. 3A.

Similarly, FIG. 3C shows the drain pan extension 325 in a third installation configuration with the pin 315 near the right edge of notch 310 such that there is an even longer distance 375 between pin 315 and the left side of the drain pan 305, compared to distances 365 and 370 of FIGS. 3A and 3B. The drain pan extension is held in the third installation configuration by stopper 320*c*. Stopper 320*c* is a greater distance from the right edge of the drain pan extension 325 than is stopper 320*b*. Because of the same geometric considerations described above, in the third installation configuration shown in FIG. 3C, the drain pan extension 325 is at a smaller angle 350 relative to angle 340 shown in FIG. 3B.

Figure 4A:
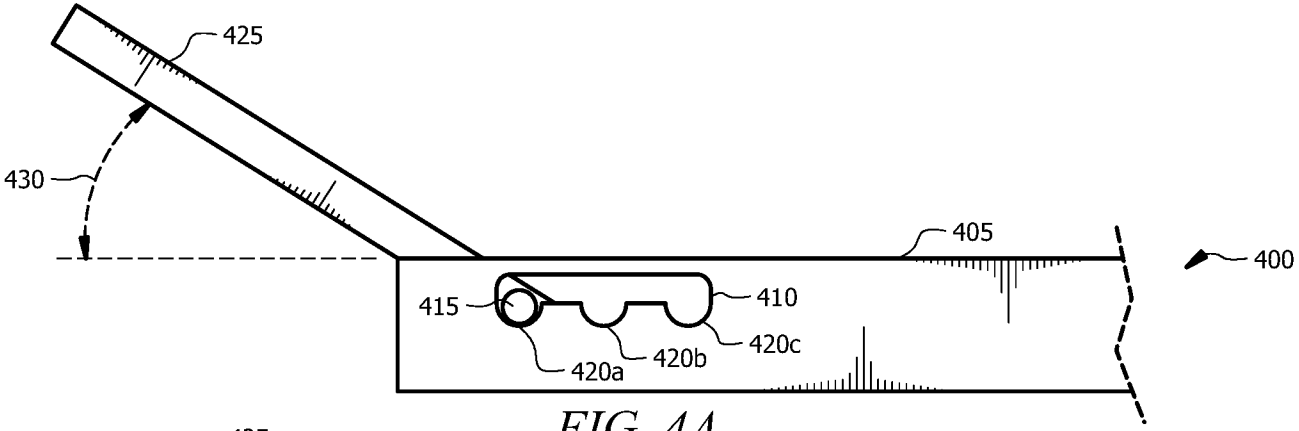
FIGS. 4A-C are diagrams of the apparatus with the drain pan extension arranged in different configurations, according to an illustrative embodiment.
Figure 4B:
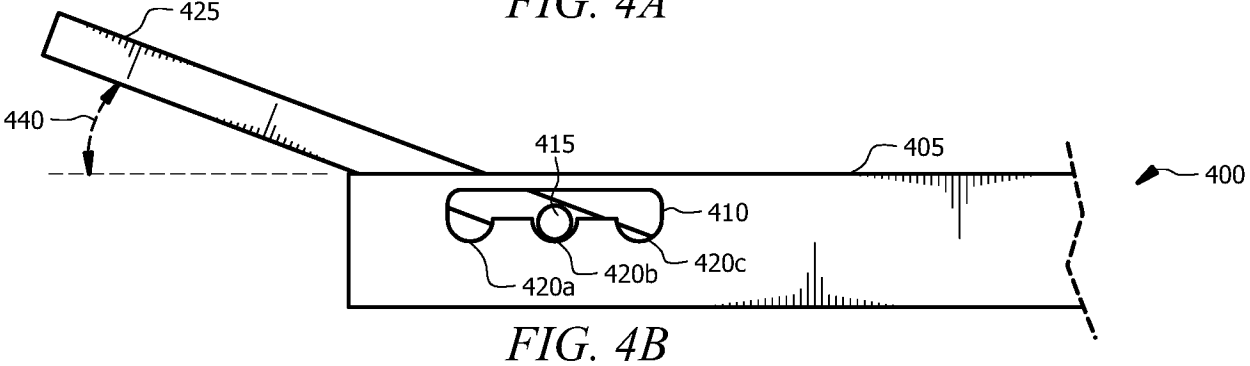
Figure 4C:
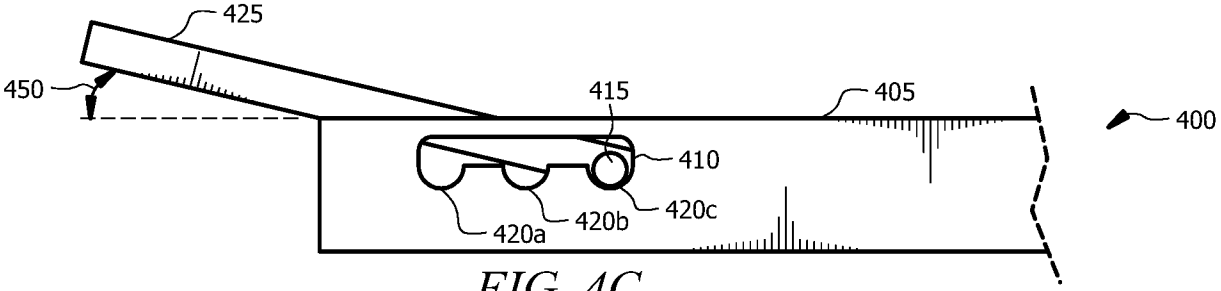

FIGS. 4A-C shows a portion 400 of an alternative apparatus that is configurable in multiple installation configurations (i.e., at multiple installation angles). For example portion 400 may be a portion of apparatus 100 shown in FIGS. 1A-B and 2A-C, described above. Accordingly, as would be understood by one skilled in the art, drain pan 405 and drain pan extension 425 may include each of the parts and features of drain pan 102 and drain pan extension 110, respectively, described above with respect to FIGS. 1A-B and 2A-C. However, in the portion 400 of the apparatus shown in FIGS. 4A-C, each of the notches 104*a,b* of apparatus 100 are replaced with a notch 410 with one or more vertical grooves 420*a-c*, and the one or more stoppers 108 of apparatus 100 are optional. In the illustrative examples of FIGS. 4A-C, the different configurations are realizable using vertical grooves 420*a-c*, which are configured to secure pin 415 in the first installation configuration of FIG. 4A (at angle 430), the second installation configuration of FIG. 4B (at angle 440), and the third installation configuration of FIG. 4C (at angle 450). In general, angle 430 is greater than angle 440, and angle 440 is greater than angle 450. The drain pan extension 425 may be securely configured without including one or more stoppers (e.g., such as stoppers 108 of FIGS. 1A and 1B) on the bottom surface of the base of the drain pan extension 425. However, in some embodiments, the drain pan extension 425 further includes stoppers on the bottom surface of the base of the drain pan extension 425 (e.g., stoppers 108 shown in FIGS. 1A-B and 2A-C).

FIG. 4A shows the drain pan extension 425 in a first installation configuration. In this configuration, the pin 415 is near the left edge of notch 410 and fitted within vertical groove 420*a* such that there is a relatively short distance between pin 415 and the left side of the drain pan 405. The drain pan extension 425 is held in the first installation configuration by groove 420*a*. The angle 430 between the drain pan extension 425 and the drain pan 405 is determined by the height of the drain pan relative to the notch 410 and the distance from the groove 420*a* to the left edge of the drain pan 405. Accordingly, in the first installation configuration shown in FIG. 4A, the drain pan extension 425 is at a relatively large angle 430.

FIG. 4B shows the drain pan extension 425 in a second installation configuration. The drain pan extension 425 is held in the second installation configuration by groove 420*b*. Groove 420*b* is a greater distance from the right edge of the drain pan extension 425 than is groove 420*a*. In this configuration, the pin 415 is near the center of notch 410 and fitted within groove 420*b* such that there is a longer distance between pin 415 and the left side of the drain pan 405, compared to the first configuration shown in FIG. 4A. Accordingly, in the second installation configuration shown in FIG. 4B, the drain pan extension 425 is at a smaller angle 440 relative to angle 430 shown in FIG. 4A.

Similarly, FIG. 4C shows the drain pan extension 425 in a third installation configuration with the pin 415 near the right edge of notch 410 and fitted within groove 420*c* such that there is a longer distance between pin 415 and the left side of the drain pan 405, compared to the distances of FIGS. 4A and 4B. The drain pan extension 425 is held in the third installation configuration by vertical groove 420*c*, which is a greater distance from the right edge of the drain pan extension 425 than is groove 420*b*. Because of the same geometric considerations described above, in the third installation configuration shown in FIG. 4C, the drain pan extension 425 is at a smaller angle 450 relative to angle 440 shown in FIG. 4B.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled may be indirectly coupled. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. An apparatus comprising:

a drain pan configured to receive liquid condensate from a horizontal evaporator coil positioned above the drain pan, the drain pan comprising:

a pan base comprising a top pan surface;

a left pan side extending along a left pan edge of the pan base and extending in an upward direction from the top pan surface of the pan base;

a right pan side extending along a right pan edge of the pan base and extending in the upward direction from the top pan surface of the pan base;

a front pan side extending along a front pan edge of the pan base and extending in the upward direction from the top pan surface, the front pan side comprising a first horizontal notch, wherein the first horizontal notch extends along a portion of the front pan side; and a rear pan side extending along a rear pan edge of the pan base and extending in the upward direction from the top pan surface, the rear pan side comprising a second horizontal notch, wherein the second horizontal notch extends along a portion of the rear pan side; and a drain pan extension slidably coupled to the drain pan, the drain pan extension comprising:

an extension base comprising a top extension surface and a bottom extension surface;

a front extension side extending along a front edge of the extension base and extending in the upward direction from the top extension surface, wherein an outer surface of the front extension side comprises a first pin positioned a first distance from a right edge of the extension base, wherein the first pin is fitted and horizontally movable within the first horizontal notch; and a rear extension side extending along a rear edge of the extension base and extending in the upward direction from the top extension surface, wherein an outer surface of the rear extension side comprises a second pin positioned the first distance from the right edge of the extension base, wherein the second pin is fitted and horizontally movable within the second horizontal notch;

wherein the bottom extension surface of the extension base comprises one or more first stoppers positioned a second distance from the right edge of the extension base such that the drain pan extension is securably configurable in:

a first configuration in which the drain pan extension extends above the drain pan at a first predefined angle relative to the drain pan; and a second configuration in which the one or more first stoppers contact the left pan side, and at least a portion of the drain pan extension extends beyond the left pan side of the drain pan at a second predefined angle relative to the drain pan.

2. The apparatus of claim 1, further comprising the horizontal evaporator coil positioned above the drain pan, wherein the second predefined angle is determined based at least in part on a height of the horizontal evaporator coil above the drain pan.

3. The apparatus of claim 1, wherein the second predefined angle is determined based on one or more of a length of the first horizontal notch, a length of the second horizontal notch, the second distance at which the one or more first stoppers are positioned from the right edge of the extension base, and a height of the one or more first stoppers.

4. The apparatus of claim 1, further comprising the horizontal evaporator coil positioned above the drain pan, wherein the drain pan extension further comprises a clasp or lock configured to secure the drain pan extension to the horizontal evaporator coil in the first configuration.

5. The apparatus of claim 1, wherein the drain pan extension and the drain pan comprise the same material.

6. The apparatus of claim 1, wherein the drain pan extension comprises a corrosion-resistant material.

7. The apparatus of claim 1, wherein the bottom extension surface of the extension base comprises one or more second stoppers positioned a third distance from the right edge of the extension base such that the drain pan extension is securably configurable in a third configuration in which the one or more second stoppers contact the left pan side and at least a portion of the drain pan extension extends beyond the left pan side of the drain pan at a third predefined angle relative to the drain pan, wherein the third distance is greater than the second distance and the third predefined angle is less than the second predefined angle.

8. An apparatus comprising:

a horizontal evaporator coil;

a drain pan attached to a base of the horizontal evaporator coil and configured to receive liquid condensate from the horizontal evaporator coil positioned above the drain pan, the drain pan comprising:

a pan base comprising a top pan surface;

a left pan side extending along a left pan edge of the pan base and extending in an upward direction from the top pan surface of the pan base;

a right pan side extending along a right pan edge of the pan base and extending in the upward direction from the top pan surface of the pan base;

a front pan side extending along a front pan edge of the pan base and extending in the upward direction from the top pan surface, the front pan side comprising a first horizontal notch, wherein the first horizontal notch extends along a portion of the front pan side; and a rear pan side extending along a rear pan edge of the pan base and extending in the upward direction from the top pan surface, the rear pan side comprising a second horizontal notch, wherein the second horizontal notch extends along a portion of the rear pan side; and a drain pan extension slidably coupled to the drain pan, the drain pan extension comprising:

an extension base comprising a top extension surface and a bottom extension surface;

a front extension side extending along a front edge of the extension base and extending normal to the top extension surface of the extension base, wherein an outer surface of the front extension side comprises a first pin positioned a first distance from a right edge of the extension base, wherein the first pin is fitted and horizontally movable within the first horizontal notch; and a rear extension side extending along a rear edge of the extension base and extending normal to the top extension surface of the extension base, wherein an outer surface of the rear extension side comprises a second pin positioned the first distance from the right edge of the extension base, wherein the second pin is fitted and horizontally movable within the second horizontal notch;

wherein the bottom extension surface of the extension base comprises one or more first stoppers positioned a second distance from the right edge of the extension base such that the drain pan extension is securably configurable in:

a first configuration in which the drain pan extension extends above the drain pan at a first predefined angle relative to the drain pan; and a second configuration in which the one or more first stoppers contact the left pan side, and at least a portion of the drain pan extension extends beyond the left pan side of the drain pan at a second predefined angle relative to the drain pan.

9. The apparatus of claim 8, wherein the first predefined angle is determined based on a predetermined rate of air flow across the horizontal evaporator coil during operation of the horizontal evaporator coil.

10. The apparatus of claim 8, wherein the first predefined angle is determined based on one or more of the length of the first horizontal notch, the length of the second horizontal notch, the second distance at which the one or more first stoppers are positioned from the right edge of the extension base, and a height of the one or more first stoppers.

11. The apparatus of claim 8, further comprising a first clasp or lock configured to secure the drain pan extension to the horizontal evaporator coil in the first configuration.

12. The apparatus of claim 8, wherein the bottom extension surface of the extension base comprises one or more second stoppers positioned a third distance from the right edge of the extension base such that the drain pan extension is securably configurable in a third configuration in which the one or more second stoppers contact the left pan side and at least a portion of the drain pan extension extends beyond the left pan side of the drain pan at a third predefined angle relative to the drain pan, wherein the third distance is greater than the second distance and the third predefined angle is less than the second predefined angle.

* * * * *